US006615758B2

(12) United States Patent
Blad

(10) Patent No.: US 6,615,758 B2
(45) Date of Patent: Sep. 9, 2003

(54) PORTABLE SAIL KIT

(76) Inventor: Robert Carl Blad, 41-951 Homewood Road, Campbell River, British Columbia (CA), V9W 3N7

( * ) Notice: Subject to any disclaimer, the term of this patent is extended or adjusted under 35 U.S.C. 154(b) by 0 days.

(21) Appl. No.: 10/067,749

(22) Filed: Feb. 8, 2002

(65) Prior Publication Data

US 2002/0112657 A1 Aug. 22, 2002

(30) Foreign Application Priority Data

Feb. 12, 2001 (CA) ..... 2335404

(51) Int. Cl.[7] ..... B63B 35/00
(52) U.S. Cl. ..... 114/39.32; 114/39.22
(58) Field of Search ..... 114/39.11, 39.12, 114/39.16, 39.21, 39.22, 39.32, 102.1, 102.29, 343

(56) References Cited

U.S. PATENT DOCUMENTS 3,889,620 A * 6/1975 Dorland ..... 114/39.21
4,077,345 A * 3/1978 Gurley ..... 114/39.32
4,130,292 A * 12/1978 Lorenz ..... 280/810
4,466,372 A * 8/1984 Rudloff ..... 114/39.12
4,512,276 A * 4/1985 Hamann ..... 114/102.12
4,646,669 A * 3/1987 Frank ..... 114/39.22
4,653,416 A * 3/1987 Debarge ..... 114/39.13
4,922,845 A * 5/1990 Boyd ..... 114/39.15
5,377,607 A * 1/1995 Ross ..... 114/39.12
D362,411 S * 9/1995 Doyle ..... D11/166
6,035,799 A * 3/2000 Lukanovich et al. ..... 114/343
6,125,783 A * 10/2000 Shimmell et al. ..... 114/343

FOREIGN PATENT DOCUMENTS

DE 3040218 * 6/1982 ..... 114/39.12

* cited by examiner

*Primary Examiner*—S. Joseph Morano
*Assistant Examiner*—Andrew Wright

(57) ABSTRACT

A "V"-shaped sail is mounted to flexible tubular members. The tubular members are permitted to flex as wind speed increases. This lowers the effective center of effort and the area of the sail and increases the stability of vessels and vehicles to which the sail is mounted without the need for operator involvement. The sail frame is mounted to a "Y" shaped yoke having a cylindrical stem. The stem is inserted into a locking base that permits rotation of the stem in 30 degree increments while preventing the stem from being removed from the anchor while the sail is set at an operating angle. The locking base can be mounted permanently or temporarily to the vessel and vehicle. One unique aspect of this invention is that no lines (sheets) or similar apparatus are required for any operational function of raising, lowering or sailing this sail kit.

14 Claims, 16 Drawing Sheets

A

B

PORTABLE SAIL KIT

CROSS-REFERENCE TO RELATED APPLICATIONS

This invention is entitled to the benefit of the Provisional Patent Application filed in the Canadian Intellectual Property Office Serial #2,335,404 filed on Feb. 12, 2001.

BACKGROUND OF THE INVENTION

Statement Regarding Federally Sponsored Research or Development

N/A

References to Microfiche Appendix

N/A

1. Field of the Invention

This invention relates to sails for vessels and vehicles and particularly to portable sail kit that can be removably attached to a vessel and vehicle for wind assisted propulsion.

2. Discussion of Prior Art

It is well known that the wind can be harnessed using a sail to assist in the propulsion of vehicles and vessels. Vehicles include wind power sleds on wheels or skids that are operable on land or ice surfaces. Vessels include canoes, kayaks and other small craft.

Numerous attempts have been made to construct a useful apparatus to harness wind power to provide propulsion. For example, U.S. Pat. No. 4,646,669 issued to Frank in 1987 entitled "Sailing Canoe Kit" describes a kit comprising a mast, mast support, sail and leeboards. Another example is found in U.S. Pat. No. 4,461,594 issued to Birkett in 1987 and entitled "Canoe Conversion Kit". Birkett describes a device comprising a framing having multiple cross-members and cross bars.

Birkett and Frank exemplify the problems associated with previously known attempts to harness wind power to propel a vehicle or vessel, namely, excessive weight, a plurality of supporting members and connecting members, sail support lines (sheets) excessive stowage bulk in vessels of limited capacity, the need for operator involvement to control the sail and rigging, and a significant amount of time taken to assemble and disassemble such devices. Such complex devices are expensive to manufacture.

Being able to easily and quickly harness wind power, for example, to propel a kayak across open water without having to resort to the cumbersome means described in the prior art provides a great advantage. It results in a significant saving of the strength for the paddler, reduces the tedium of paddling and adds an additional element of enjoyment to the sport. An even greater advantage is being able to transport on board, quickly assemble and disassemble a sail safely in open water without having to go to shore.

Therefore, there is an ongoing requirement for a device to permit the wind propulsion of vessels and vehicles that is light weight, easy to transport on board vessels of limited capacity, inexpensive to purchase and easy to use by a novice operator.

SUMMARY OF THE INVENTION

My invention relates to a portable sail kit for vehicles and vessels that is easy to transport, assemble, disassemble and use. The sail kit of my invention comprises a sail, a sail frame, a yoke to hold the sail frame, a locking-base for receiving the yoke and means to fix the locking-base to the deck of the vessel or vehicle. The locking-base is the principal anchorage piece in the kit and serves to anchor the sail, sail frame and yoke to the vehicle or vessel. In one embodiment of my invention, and using a kayak as an example, the locking-base is mounted directly to the top surface of the deck of the kayak. In another embodiment of my invention, the locking-base is fixed to a detachable mount. In yet another embodiment of my invention the locking-base is permanently fixed by means of an adaptable base plate bolted to the vessel or vehicle. The detachable mount may comprise a base plate attached to a plurality of suction cups. Referring again the kayak example, the locking-base is fixed to a base plate and the base plate is in turn detachably mounted to the deck of a kayak by means of suction cups. In another embodiment of my invention applied to a kayak, the locking-base is bolted directly and permanently to the deck of the kayak. The locking-base may be mountable in either a vertical or horizontal orientation depending on the orientation of the vehicle or vessel mounting surface. Corrosion resistant stainless steel nuts and bolts are used to attach the locking-base either to the base plate or directly to the deck of the example kayak. The locking-base may be injection molded using a nylon-based composite material that is both strong and lightweight.

The locking-base has both a horizontal and vertical bore. The bores are adapted to receive the stem of a "Y" shaped yoke in either vertical or horizontal mounting. When the locking-base is mounted horizontally, the "Y" shaped yoke is insertable into vertical bore within the locking-base only when the axis of the yoke is co-axial with that of the locking-base. Once the yoke is inserted into the locking-base and turned to an operating or sailing position, the yoke is locked within the locking-base by locking means and prevented from becoming detached from locking-base when the sail is operating.

The sail of my invention is in the shape of an inverted isosceles triangle. The sail is framed by two hollow tubes taking a substantially "V" configuration when the sail is unfurled. A window is located within the sail to permit viewing through it. The tubes are sectional and jointed to allow easy collapse and stowage. Tension cords are installed between the sections of the tubes to provide a compressive force to the joints when the sail is unfurled and to prevent the individual sections from getting lost when the tubes are disassembled and stowed. The sails can be manufactured in a variety of sizes. One advantage of my sail and frame design is that it is freestanding and can be operated hands-free. It requires no supporting ropes, guys or sheets. As well my sail is designed to automatically lower the effective center of effort or mass of the sail. The sail is self-regulating in strong winds and gust situations. This helps minimize destabilization of the vessel or vehicle to which it is attached.

My kit also includes a convenient and water proof bag for stowing the sail and sail frame tubes when not in use.

OBJECTS AND ADVANTAGES OF THE INVENTION

Accordingly, several objectives and advantages of my invention are listed below.

It is an object of my invention to provide a portable sail kit that overcomes the deficiencies noted above.

It is a further object of my invention to provide a portable sail kit that can be used to harness wind power to assist in the propulsion of vessels and vehicles.

Another object of my invention is to provide a portable sail kit that is easy to operate by novice operators, ultra light weight and easy to stow onboard vessels and vehicles of limited capacity.

Yet another object of my invention is to provide a portable sail kit having a sail that is freestanding.

Still another object of my invention is to provide a portable sail kit having a sail that operates hands free and requires no additional devices such as rudders, keels, leeboards or outriggers.

Another object of the invention is to provide a portable sail kit having a sail that can be easily raised or lowered and stowed by an operator in less than one minute.

A further object of my invention is to provide a portable sail kit having a sail that is self-regulating and automatically adjusts its center of effort to suit wind speeds.

Yet another object of the present invention is to provide a portable sail kit that takes advantage of light weight and modern construction materials.

Further objects and advantages of my invention will become apparent from consideration of the drawings and ensuing description.

DETAILED DESCRIPTION

In considering the detailed description and drawings of my invention, it is to be understood and will be understood by a person skilled in the art that my invention may be used on vessels and vehicles such as canoes, kayaks, other small vessels or craft, and wind-powered ice and snow boats, and wind powered land vehicles having wheels, skids and runners. However, throughout the detailed description and the drawings, reference will be made to the application of my invention to kayaks to most effectively illustrate the features of my invention.

Figure 1:
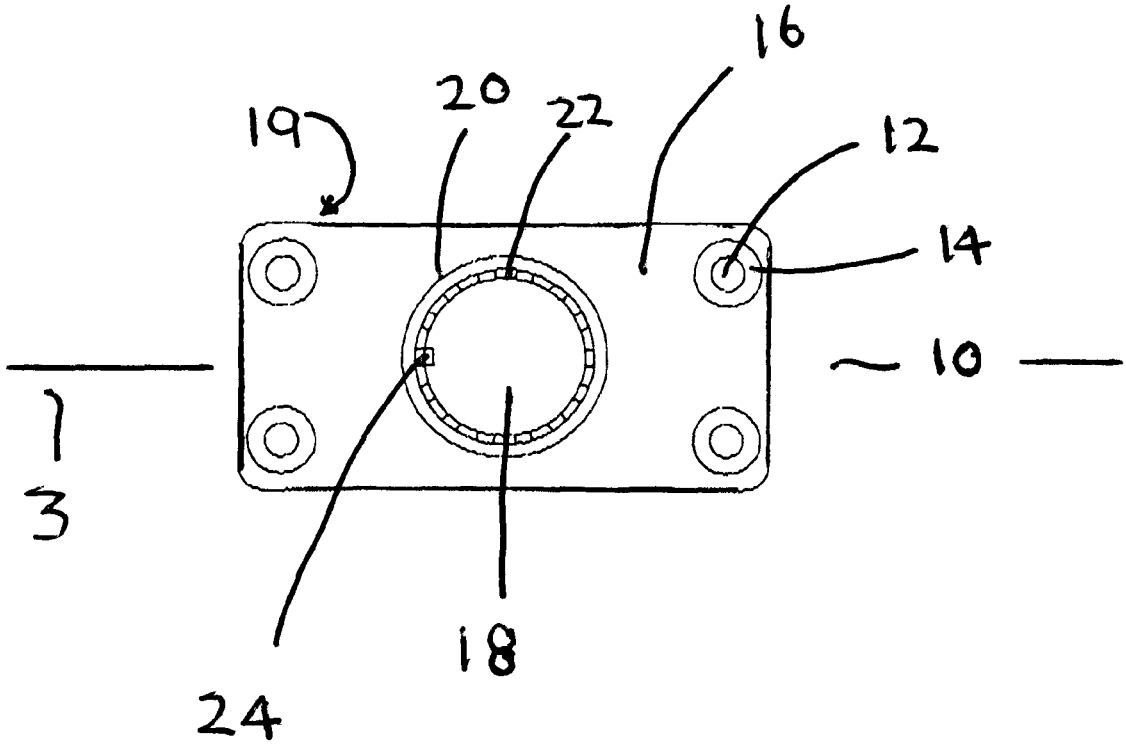
FIG. 1 illustrates in plan view the locking-base of one embodiment of my invention.

Referring now to FIG. 1, there is shown in plan view one embodiment of the locking-base (10) of the invention. In this view, the locking-base is rectangular in profile. The locking-base is apertured (12) at its four corners for receiving bolts to fix the locking-base to the kayak deck, base plate or other base mounts further as described below. In a preferred embodiment of the invention the bolts are stainless steel. The apertures (12) are recessed (14) within the block so that the heads of the bolts do not protrude above the top surface (16) of the locking-base. Looking now at the top surface (16) of the locking-base there is shown a vertical bore (18) that connects the top surface (16) of the locking-base with the bottom surface (19-not shown) of the locking-base. The bore (18) is located in the center of the locking-base (10). Rising up from the top surface (16) of the locking base and surrounding the top end of the bore (18) is collar (20). Collar (20) is integral to the locking-base (10). As more fully described below, collar (20) reinforces and stiffens the locking-base (10) at a point where the wind generated torque will be greatest. The locking-base is preferably a unibody injection-molded component from a nylon-based composite material that is lightweight, strong and resistant to weathering.

Still referring to FIG. 1, within the collar (20) is a plurality of splines (22) spaced equidistantly around the inner circumference of the collar. The length of the splines is substantially equal to the height of the collar. There is also a single key member (24) located midway down the vertical bore (18) and is integral to the locking-base.

Figure 2:
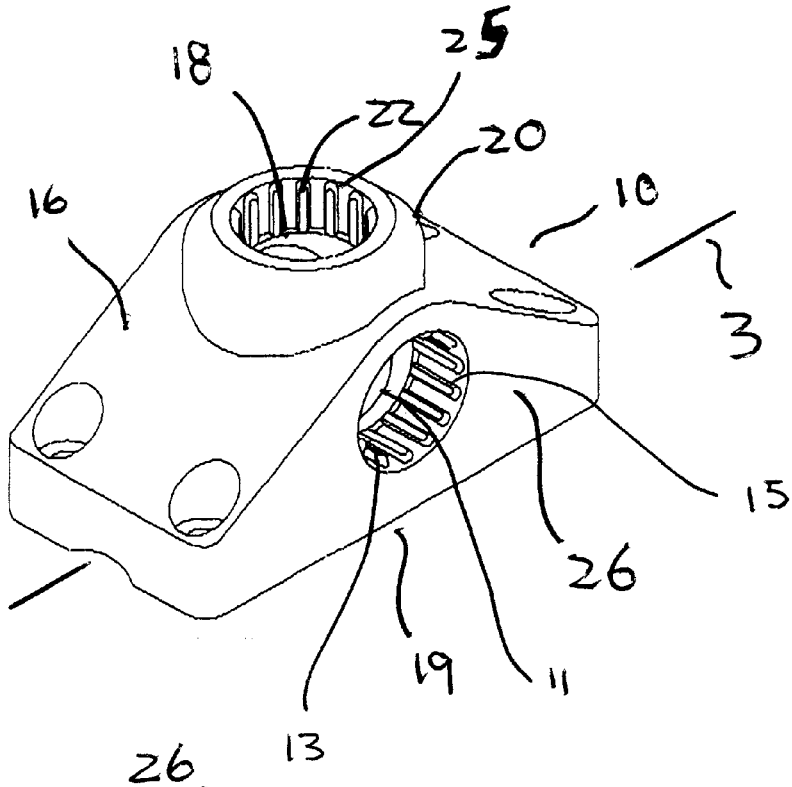
FIG. 2 illustrates in perspective view the locking-base of another embodiment of my invention.
Figure 2:
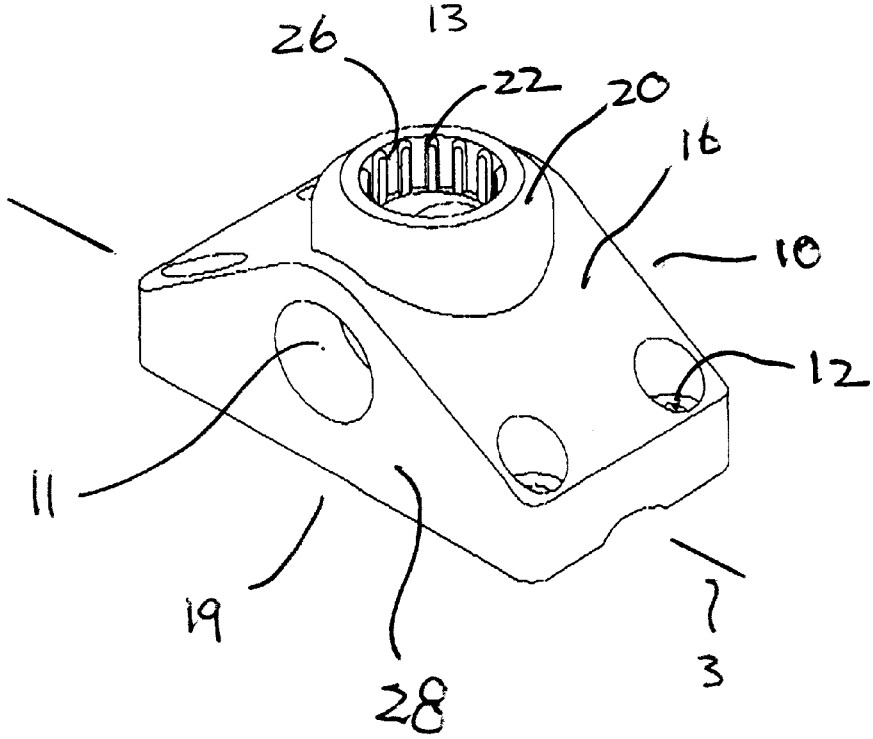

Referring now to FIG. 2, FIG. 2A is a perspective front view of the locking-base (10) and FIG. 2B is a perspective rear view of the locking-base (10). The locking base has a top surface (16), a bottom surface (19), a front surface (26) and a back surface (28). The recessed apertures (12) are shown in each corner of the locking-base. Collar (20) rises from the upper surface (16) of the locking-base. Splines (22) have upper ends (26) that are rounded. The length of the splines is substantially equal to the height of the collar.

Figure 3:
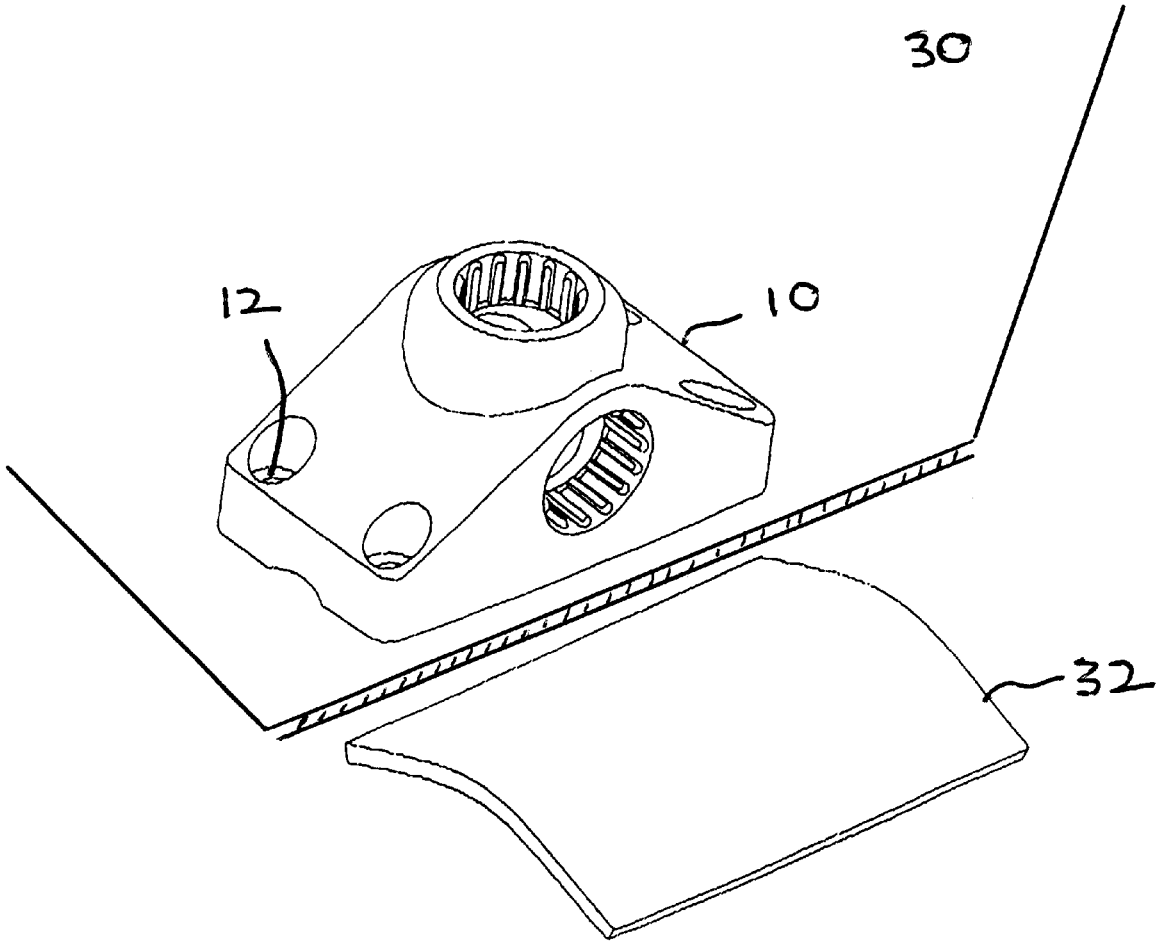
FIG. 3 illustrates one way to permanently mount the locking-base to a vehicle or vessel in one embodiment of my invention.

Referring to FIG. 3, there is illustrated one embodiment of my invention in which the locking-base (10) is mounted permanently and directly to the surface (30-shown in cross section) of a vessel deck such as a kayak. In a kayak, the locking-base will be mounted on the crown of the kayak deck as this is the strongest portion of the deck. Bearing plate (32) is first molded to the shape of the kayak deck. This is accomplished by heating the bearing plate until it is flexible, placing the bearing plate on the curved top surface of the deck where the locking-base is to be mounted and allowing the bearing plate the solidify in that shape. This shape will conform to the deck under surface. The locking-base is placed in its desired position which is in front of the cockpit of the kayak. Holes are drilled through the deck surface (30) and the bearing plate (32) using the apertures (12) as a guide. The locking-base is then bolted to the deck using stainless steel nuts and bolts. The bearing plate acts to reinforce the section of the kayak deck (30) that will sustain wind generated forces transmitted to the locking-base. The bearing plate may be manufactured from a non-ferrous lightweight material able to resist salt corrosion. Preferably the bearing plate is an extruded thermoplastic.

Figure 4:
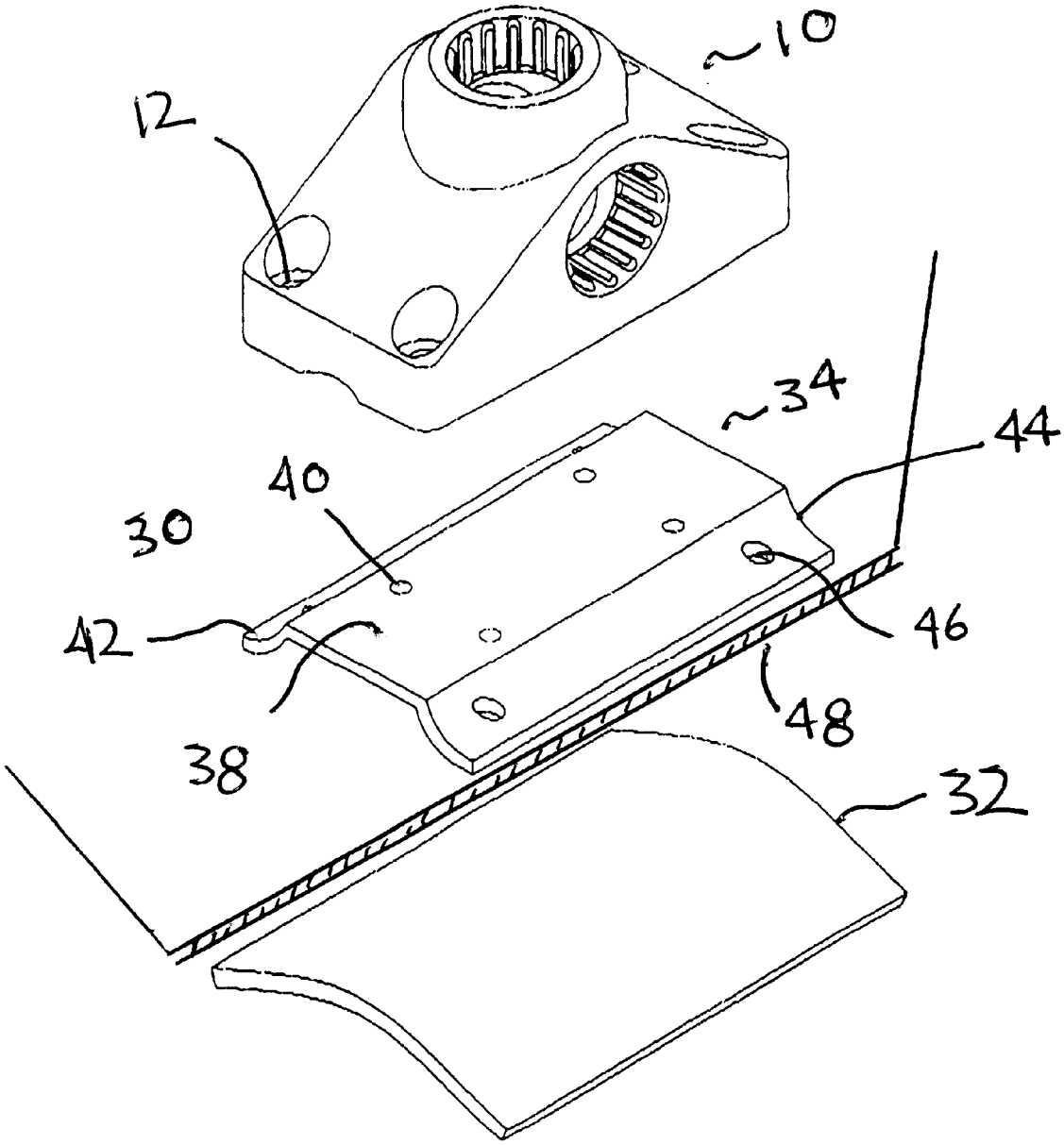
FIG. 4 illustrates another way to permanently mount the locking-base to the vehicle or vessel in another embodiment of my invention.

Referring now to FIG. 4, there is shown another embodiment of my invention in which the locking-base (10) is permanently mounted to the deck of a kayak (30) using a base plate (34). In this embodiment the base plate (34) is substantially rectangular and intended to span an irregular surface. The base plate is made from a non-ferrous and light weight material preferably an extruded thermoplastic. The base plate comprises a flat upper portion (38) having apertures (40) that correspond to the apertures (12) of the locking-base. The locking-base (10) is first bolted to the base plate (34) using stainless steel bolts and nuts. The base plate (34) also comprises flanges (42) and (44) integral thereto. The flanges are disposed outwardly and downwardly from the upper surface (38) and have a curvilinear shape. The shape adds to resilience of the base plate and helps the overall structure resist wind generated loading transmitted to the base plate from the locking-base. The flanges are apertured (46). In order to mount the locking-base (10) to the deck of the kayak (30), the procedure described above is used. First the bearing plate (32) is softened by heating and draping it over the upper surface of the kayak deck (30) where the base plate (34) is to be mounted so that it takes the form of the deck under surface (48). Then the base plate (34) is placed in its mounting position and holes are drilled through the kayak deck and bearing plate using apertures (46) as a guide. The base plate is then bolted to the deck of the kayak using stainless steel nuts and bolts.

Figure 5:
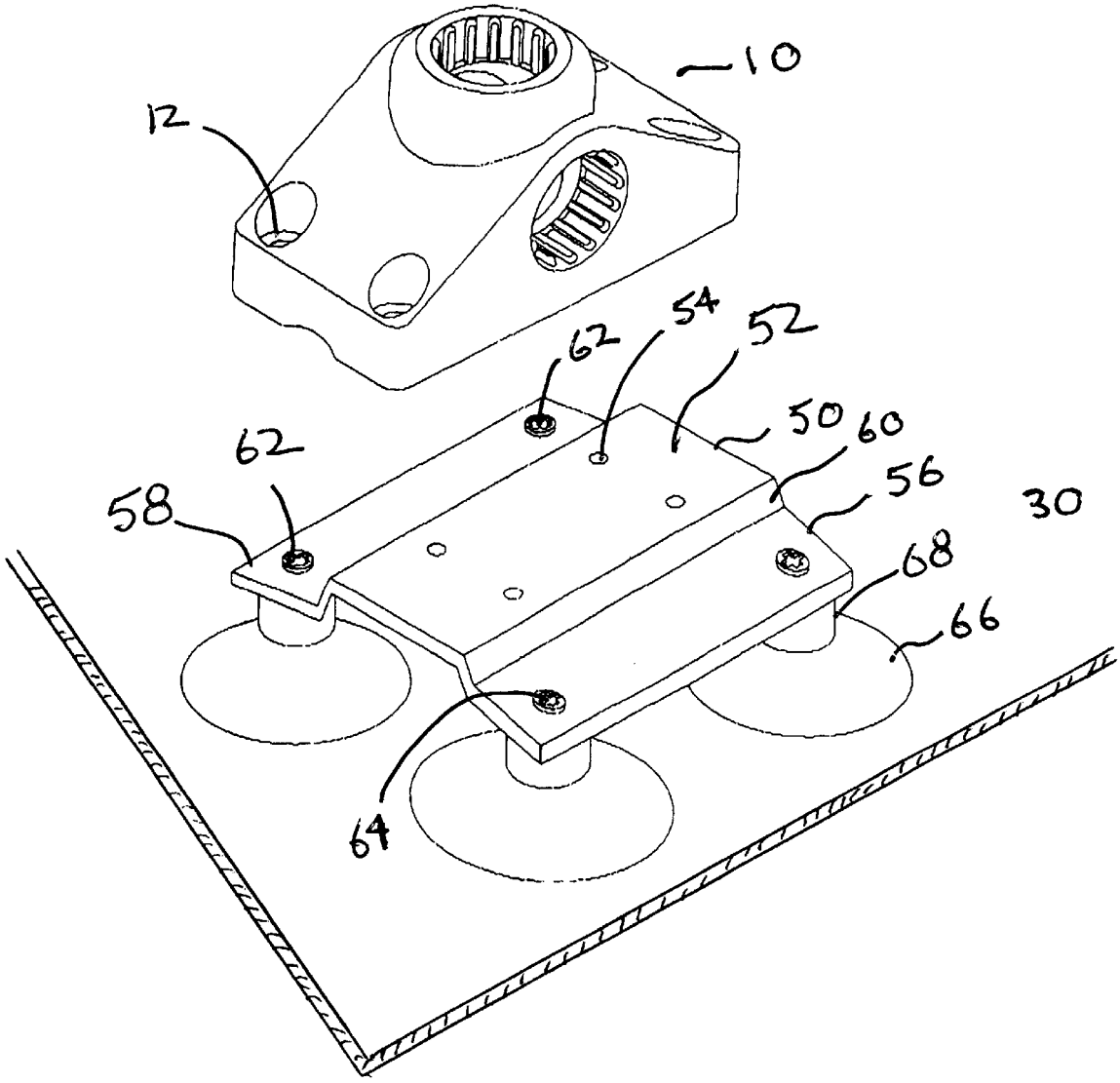
FIG. 5 illustrates one way to detachably mount the locking-base to a vehicle or vessel in another embodiment of my invention.

Referring now to FIG. 5, there is shown one embodiment of my invention in which the locking-base (10) is detachably mounted to the deck (30) of a kayak without the need to drill holes through the surface of the deck. This embodiment makes use of a base plate (50) that comprises a substantially flat upper portion (52) to which locking-base (10) is mounted. The upper surface (52) comprises a plurality of apertures (54) corresponding to the apertures (12) in the locking-base (10). The locking-base (10) is first mounted to the base plate (50) using stainless steel nuts and bolts. The base plate (50) further comprises a first flange (56) and second flange (58) that are integral to flat upper portion (52) of the base plate (50) and disposed downwardly lengthwise from the flat upper portion (52). The flat upper portion and the flanges are separated by a stiffening element (60) which has the effect of raising the flat portion of the base above the flanges (56) and (58) and adds additional resilience to the base plate so that it may more effectively resist the forces generated by the wind acting upon the sail transmitted to the locking-base (10). Each flange (56) and (58) has at two apertures (62) located at their respective lengthwise ends for receiving stainless steel bolts (64) for mounting the base plate (50) to suction cups (66). The base plate (50) is extruded from a thermoplastic material that is cut to a desired length. The material is sufficiently resilient to resist wind generated loading as well as being able to withstand cold weather and water conditions without becoming brittle and potentially cracking or shattering. Integral to the suction cups (66) are posts (68) that lift the base plate (50) off of the deck (30). The posts have center bores. At the bottom of the bore is a stainless steel nut (not shown) adapted to receive a stainless steel bolt (64) thereby fixing the four corners of the base plate (50) to the suction cups (66). The suction cups (66) are rubber and are sufficiently sized to ensure adequate adhesion to the smooth-finish deck surface (30) of the kayak. Since the suction cups fix the entire sail rig to the deck of the kayak they must be sufficiently sized to counter the torque developed by wind forces.

Figure 6:
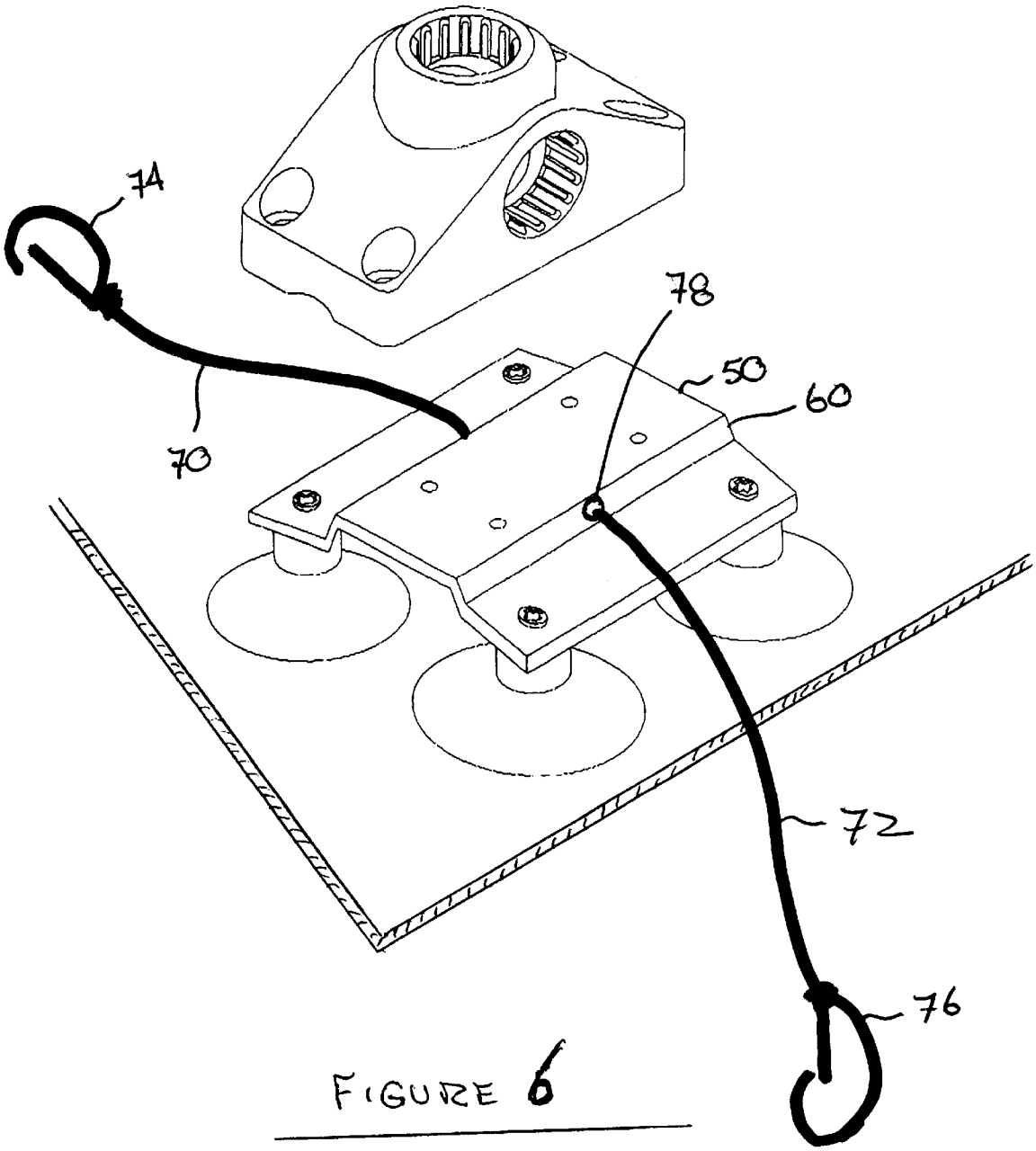
FIG. 6 illustrates yet another way to detachably mount the locking-base to a vehicle or vessel in yet another embodiment of my invention.

Referring now to FIG. 6 and in another embodiment of my invention, a tension cord (70) and (72) with fastening hooks (74) and (76) may be used to further secure the base to the kayak. Element (60) is apertured (78) so that the cords can penetrate the element in its center. The hidden end of the cords (70) and (72) are anchored behind element (60) to prevent them from pulling out of the element. The cords are attached to the sides of the kayak using the clips (74) and (76). This arrangement may add additional stability and security to the base plate. In the event that the base comes free from the deck of the vessel the apparatus will remain attached to the vessel and not lost overboard.

Figure 7:
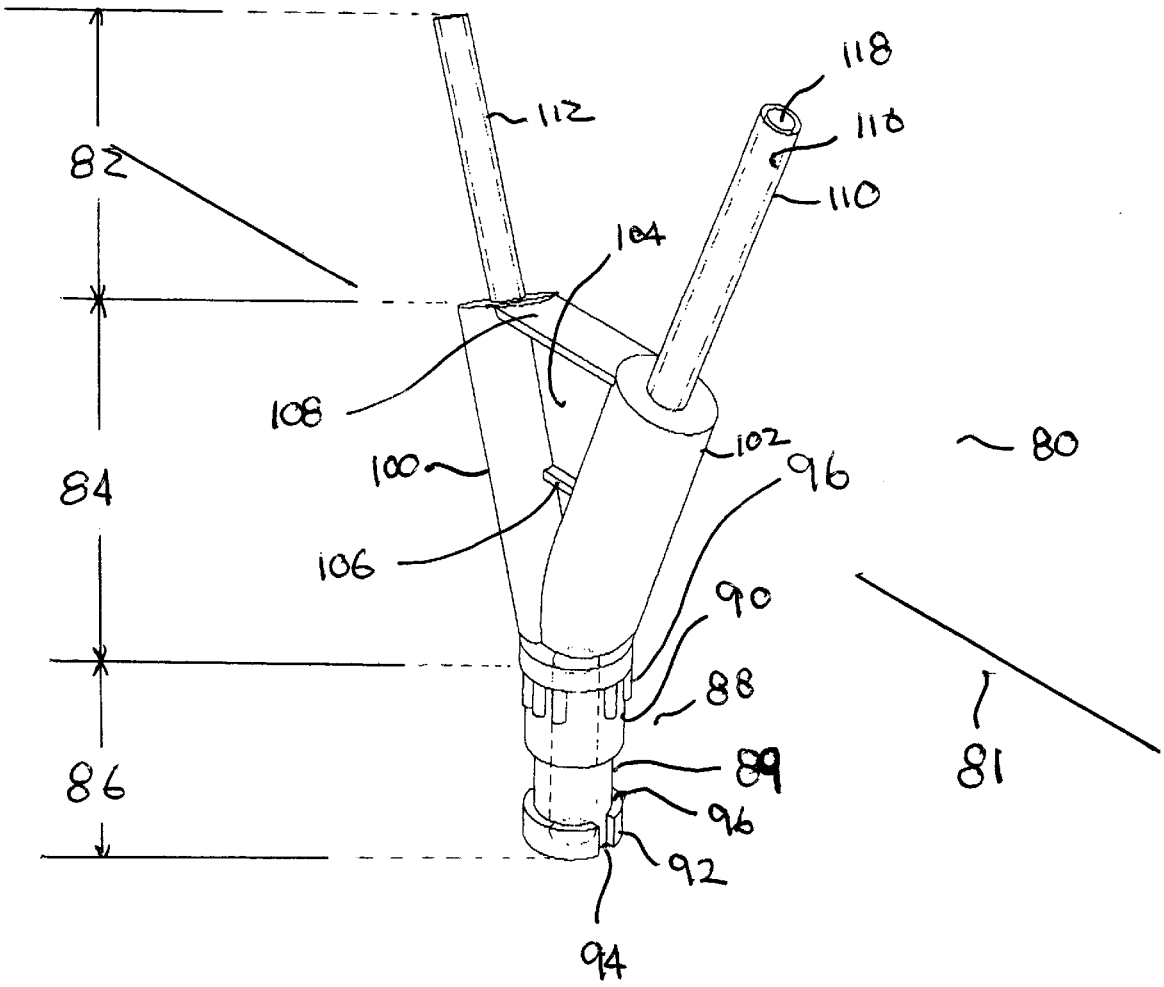
FIG. 7 illustrates the yoke of one embodiment of my invention.

Referring to FIG. 7, there is described the yoke (80) of one embodiment of my invention. For ease of reference and description the yoke (80) is divided into a top portion (82) a middle portion (84) and a bottom portion (86). In operation the bottom portion (86) is inserted into the bore (18) of the locking-base (10) as more fully described below. The top portion (82) of the yoke receives the bottom ends of the hollow tubed sail frame as more fully set out below.

Still referring to FIG. 7 the lower portion (86) of the yoke (80) comprises a stem (88). The stem is cylindrical and is adapted for insertion into the bore ( 8) of locking-base (10). The stem comprises a lower portion (89) and a n upper portion (90). The lower portion has a diameter that is less than the upper portion. The bottom of the lower portion (89) includes a split collar (92) having gaps (94) disposed opposite to each other on the bottom of the stem. The gaps (94) are adapted to receive key member (24) in the bore (18) of the locking-base (10). The split collar also comprises an upper surface (96) the purpose of which is to engage the bottom surface of the key member (24) to lock the stem (88) into the bore (18) when the sail is in operation.

Referring to FIG. 1 and FIG. 7, the first locking action of the locking-base is now described. The yoke (80) is insertable into the locking-base only when the axis of the yoke (81) is aligned with the axis (3) of the locking-base (10). When the yoke and locking-base are co-axial, gap (94) on the stem of the yoke is aligned with key member (24) within bore (18). This permits the collar (92) to pass the key member (24) allowing partial inserting of the stem (88). Once the stem is partially inserted into the bore, it may be rotated to an angle that will permit the sail to capture the wind. Once the stem is turned to any angle other than the angle where the locking-base and yoke are co-axial, the stem will not be permitted to exit the bore. Lifting the yoke will cause the upper surface (96) of the split collar (92) to engage the lower surface of the key member and obstruct its upward movement. Therefore, this first locking action of the locking-base has the advantage of ensuring that the yoke and the sail attached to it do not fall out of the locking-base while sailing.

Referring to FIGS. 1, 2 and 7 the second locking action of the locking-base is described. In FIG. 7, the upper portion (90) of the stem (88) comprises a plurality of splines (96) spaced around the circumference of the upper portion. Splines (96) are substantially identical to the splines (22) located in the collar (20) of the locking-base (10). Once the stem (88) is partially inserted into the bore (18) the bottom portion of the splines (96) and the top portion of the splines (22) will partially intermesh so that free rotation of the yoke within the locking-base is prevented. In order for the paddler to set the sail in a desired position, she has only to slightly lift yoke so that the partially engaged splines are disengaged. As described above, the stem is free to rotate in the bore but cannot be removed because of the engagement of the upper surface of the split collar (96) and the key member (24). The paddler will then set the sail at the desired angle and push downward on the yoke so that the splines intermesh. The second locking action of the locking-base occurs when the paddler pushes the yoke firmly into the locking-base so that the splines are fully intermeshed and the stem is firmly and entirely seated within the bore.

Figure 8:
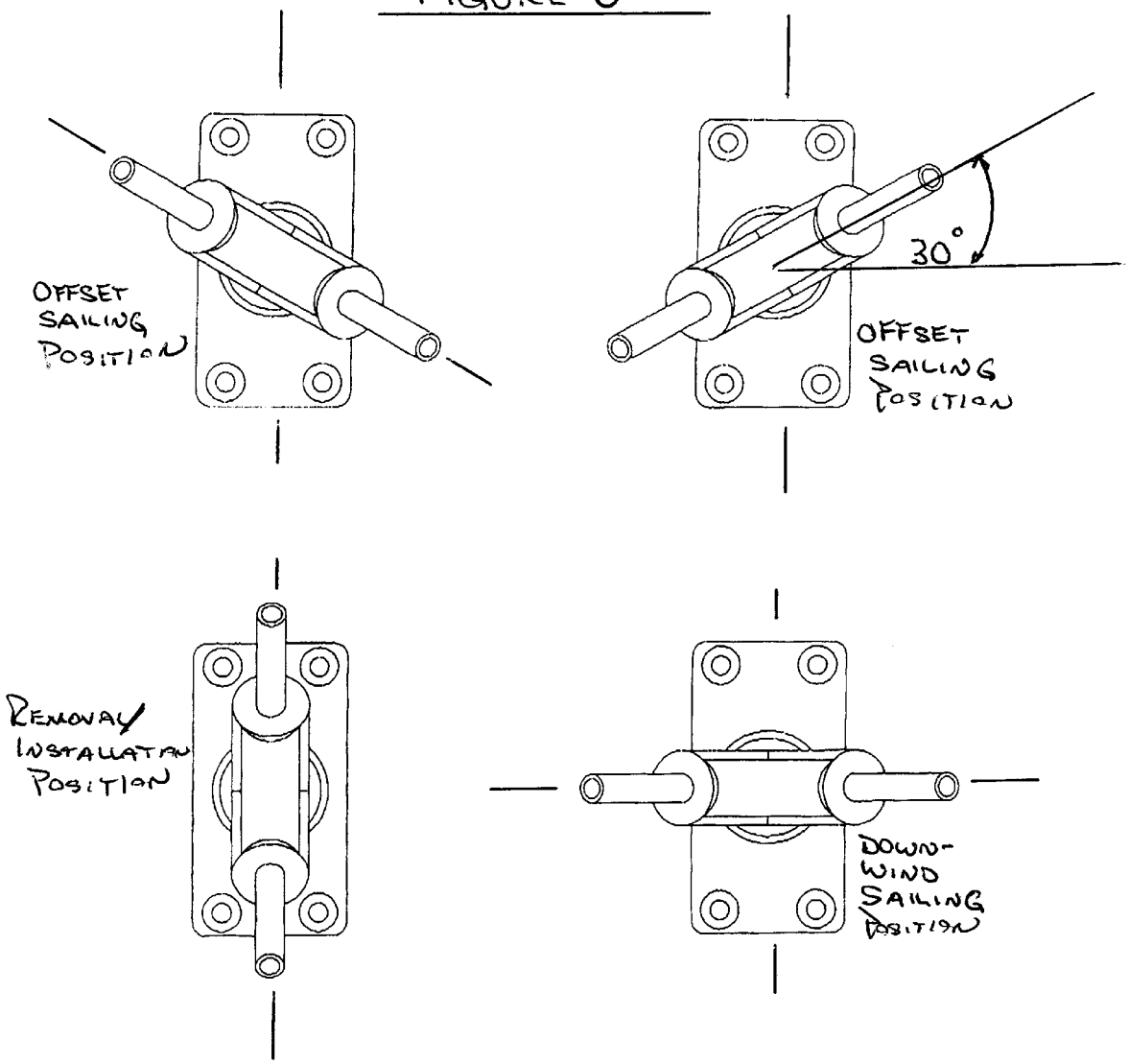
FIG. 8 illustrates in plan view a variety of positions the yoke may assume once inserted into the locking-base in one embodiment of my invention.

Referring now to FIGS. 2, 7 and 8 the manner in which the sail can be set to a specific angle relative to the axis of the kayak is explained. In FIG. 7 there are shown splines (96) integral to the top portion (90) of the stem (88). There are 8 such splines. Looking at FIG. 8 and the top portion (90) of the stem (88), 3 splines are mounted in front of the axis (81), 3 behind the axis and one on either side of the stem along the axis. These splines are spaced apart in such a way to permit meshing about the splines of the collar only in 30 degree increments. As shown in FIG. 8, the yoke may be rotated to 30 degrees to either side of the perpendicular to the axis of the locking base (10) for offset sailing or placed perpendicular to the axis of the locking-base for down wind sailing. As described above, when the yoke and locking-base are co-axial, the yoke may be removed from or inserted into the locking-base.

Referring back to FIG. 7, the yoke further comprises a middle portion (84). The middle portion is substantially "V" shaped having arms (100) and (102). Web (104) connects the arms (100) and (102). Included with web (104) are stiffening members (106) and (108). It will be understood by a person skilled in the art that the thickness of the body portion (84) and the web (104) will be sufficient to resist the forces transmitted from the sail to the yoke and sufficient to resist appreciable flexing.

Still referring to FIG. 7, the yoke (80) further comprises an upper portion (82). The upper portion (82) comprises two receiving tubes (110) and (112) extending co-axially from the arms of the "V" shaped middle portion (84). The tubes are respectively integral to the arms (100) and (102). The yoke tubes are adapted to receive in a sliding engagement the bottoms of the sail frame tubes as more fully described below. In one embodiment of my invention where a larger size sail is used, the tubes (110) and (112) are reinforced by inserting a steel reinforcing rod (116) down their hollow centers (118) and sealing the inserted rod from external elements with a layer of epoxy. This provides additional resistance to flexure caused by wind forces acting on the sail frame. The tubes are constructed from a fiber reinforced composite or epoxy tubing. During construction of the "V"-shaped yoke, the tubes are placed into the mold and the mold material is then injected into the molds and around the tubes forming a yoke having a unibody construction. A keyway in the wall of the wall of the embedded tube insert anchors the tube to the molded yoke (not shown).

Figure 9:
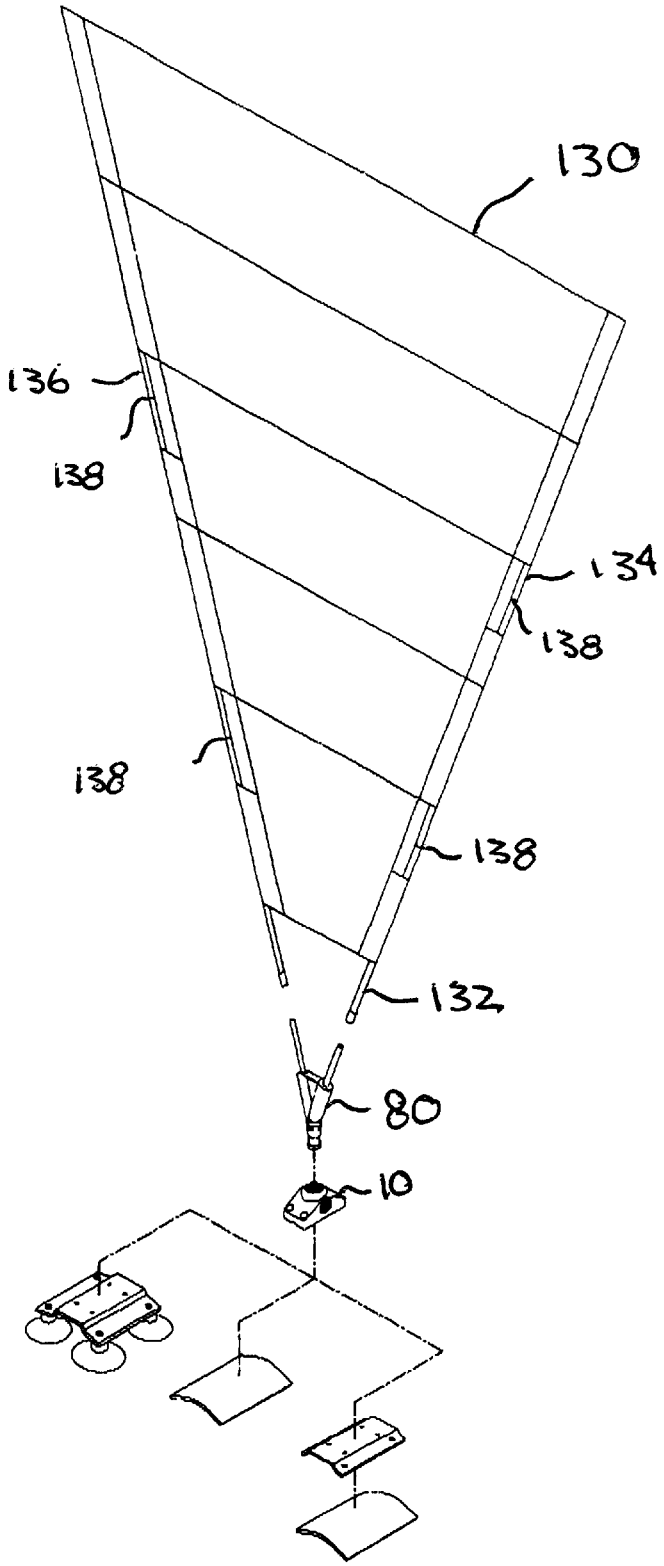
FIG. 9 is a view of the manner in which the sail kit of one embodiment of my invention is assembled showing three ways to mount the locking-base to the vessel or vehicle.

Referring to FIG. 9, one embodiment of the sail (130) and sail frame (132) is shown. The sail frame (132) comprises a pair (134) and (136) of elongated tubes extending upwards from the yoke (80). The angle of separation between the frame tubes is equal to that of the arms of the yoke thus giving the sail an inverted isosceles triangle configuration. Tubes (134) and (136) are sectioned and collapsible at joints (138) to reduce their length for stowage convenience.

Figure 10:
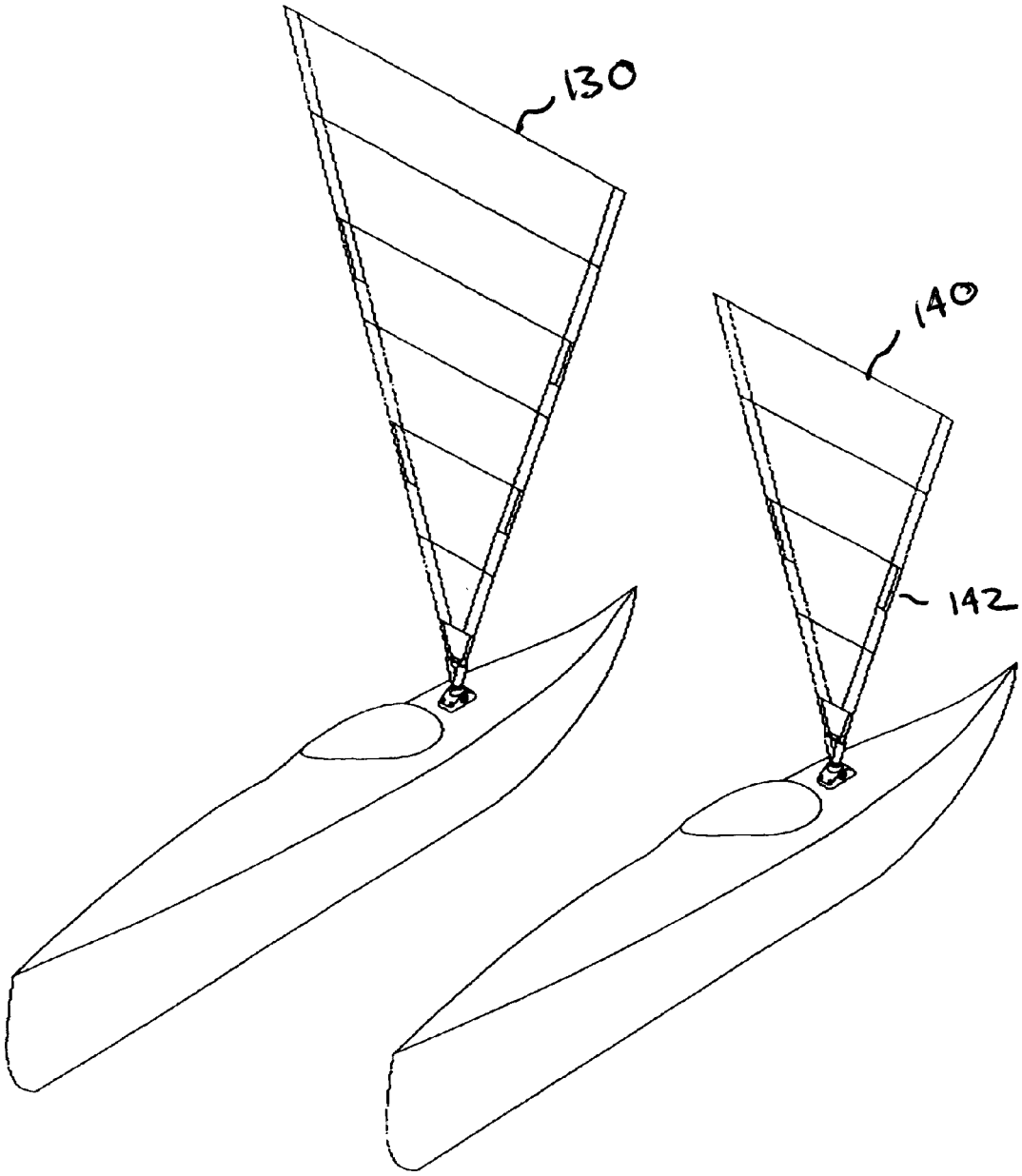
FIG. 10 illustrates two different sizes of sails in two different embodiments of my invention.

Referring to FIG. 10, my invention permits the use of sails of differing sizes. The larger sized sail is that shown in FIG. 9 as (130) and has two more sail panels than the smaller sail (140). The sail frame tubes for the smaller sail have a single joint (142) and are collapsible into two sections.

FIG. 9 also shows the three mounting configurations of the locking-base onto the surface of the kayak as previously described.

As noted above, the sails can be configured large or small. For the larger sail a longer three-section tube is used. The construction and operation of the tube is further explained by referring to FIG. 11.

Figure 11:
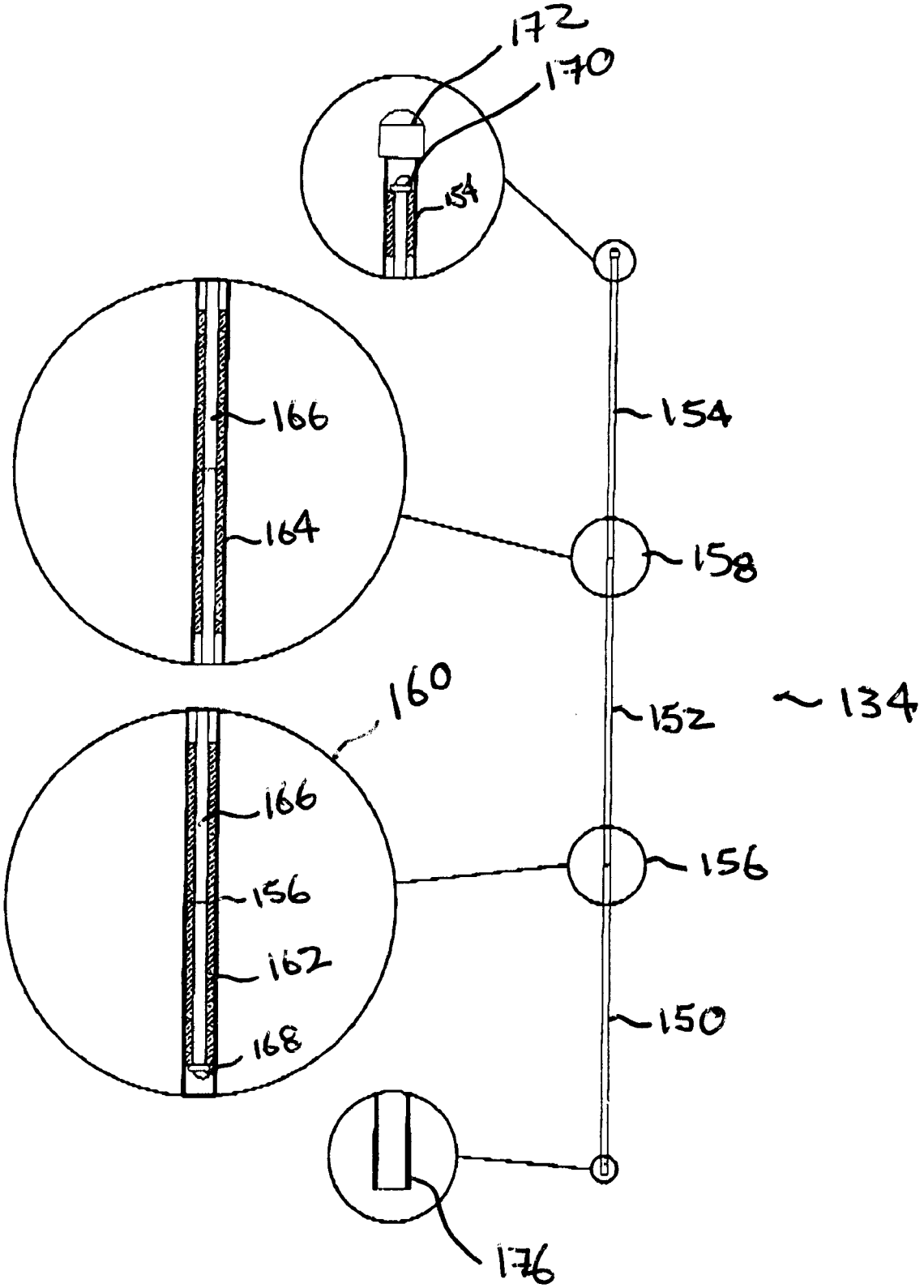
FIG. 11 illustrates a sail frame tube in one embodiment of my invention.
Figure 12:
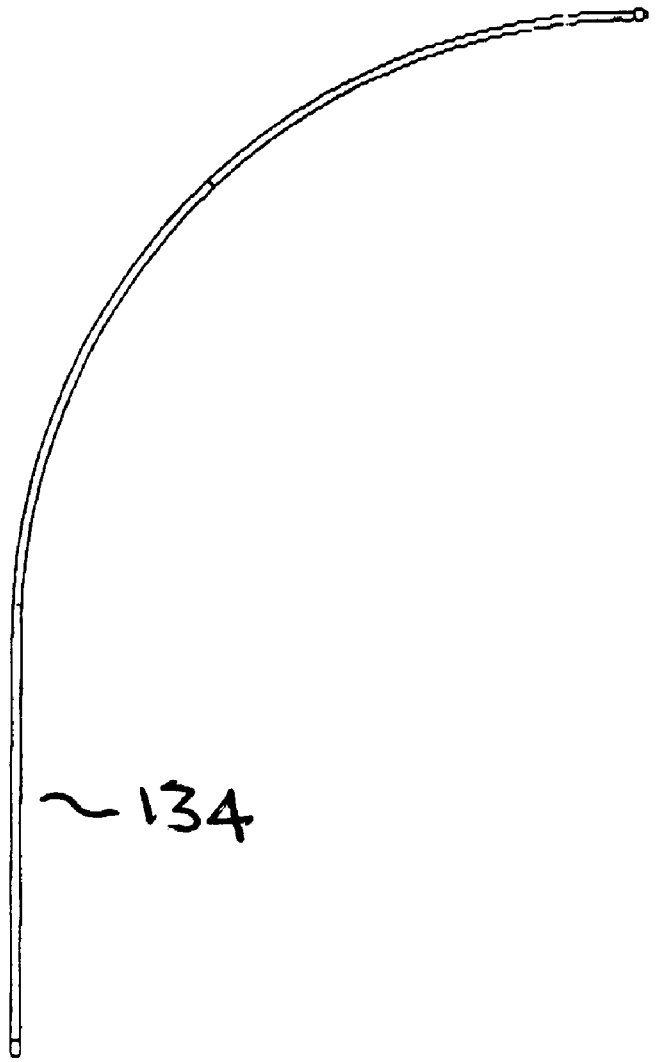
FIG. 12 illustrates the flexure of the tube in FIG. 11.

In FIG. 11, there is shown a detailed view of the tube frame members used to frame the larger sail. In the embodiment shown tube (134) is a three section (150), (152) and (154) tube with joints (156) and (158). The tubes are preferably manufactured from a fiber reinforced composite or epoxy material. An important and advantageous feature of my invention is the ability of the sail to automatically lower the effective center of effort of the sail when the wind speed increases. This is accomplished by slightly decreasing the tube wall thickness of segments (152) and (154). For example, the tube wall thickness of segment (150) may be a few thousands of an inch more than the upper two segments (152) and (154). This permits stiffness at the bottom of the sail frame member (134) to resist the bending moments caused by the sail but allows significant flexure of the upper portion of the frame member as shown in FIG. 12. In FIG. 12, the upper portion of the frame member (134) may bend as much as 90 degrees from the horizontal in strong winds. This ability of my sail frame to flex in strong winds and gusts permits the sail to spill wind in an automatic and controlled manner without any intervention by the paddler. Therefore, in a strong gust the effective amount of sail area is reduced to control the forces applied to the kayak and to prevent destabilizing motions that might otherwise be imparted to the kayak. A further advantage of the framing arrangement of my sail is that the frame members (134) and (136) are sufficiently rigid to support the sail in a free standing configuration without the need for additional guys or sheets in reasonable sailing winds.

Referring to FIG. 11 a detailed description of the joint (156) and (158) is provided. In FIG. 11, joint (156) is shown in an enlarged view (160). Joint (156) connects the top of segment (150) to the bottom of segment (152). Inserted into the top of segment (150) is a dowel (162). The outer diameter of the dowel is less than the inner diameter of the tube segment (150) so that it can be inserted into the tube in a slideable frictional fit. The dowel is made from a similar material as the tube. About half the length of the dowel is inserted into the tube so that about half remains outside the tube. Since it is undesirable for the dowel to move within the bottom segment, the dowel is fixed in place by a suitable adhesive. The exposed half is adapted to receive in a sliding frictional engagement the bottom portion of tube segment (152).

A tension cord (166) of a suitable diameter and construction is placed within segments (152) and (154) being anchored within segment (150) by anchoring means (168) at the bottom of dowel (162). The top end of the cord is anchored (170) at the top end of segment (154). At the top end of segment (154) a section of dowel is fixed into place within the segment and the top of the cord is restrained by a washer and knot. Similarly at the bottom of dowel (162) the bottom of the cord is restrained by a similar washer and knot arrangement. The tension cord has two primary purposes. The first is to provide a compressive force between the joined segments so that they do not easily come apart when the sail is in operation. The other purpose is to keep the rods together for easy of stowage and assembly. The open end of the top rod (154) is capped with a rubber cap (172) to keep the elements out. The bottom end of the bottom segment (150) is fitted with a guard ring (176) to minimize unnecessary abrasion between the bottom of the bottom segment (150) and the top of the receiving tubes (110) and (112) on the yoke.

Such abrasion may cause the filaments in the tubes to separate and the tube to weaken. The guard ring also serves to strengthen the end of the tube.

Figure 13:
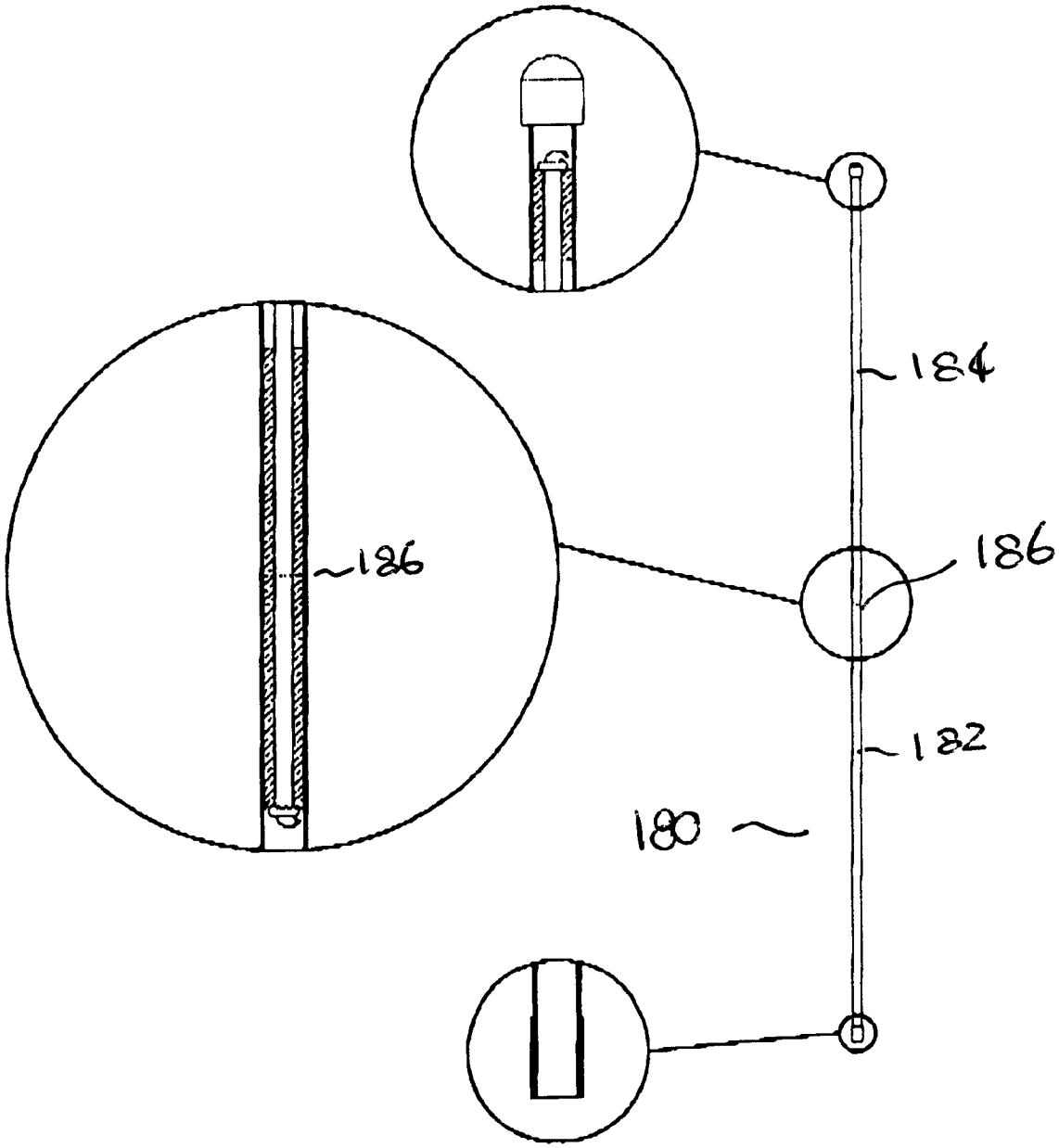
FIG. 13 illustrates a sail frame tube in another embodiment of my invention.
Figure 14:
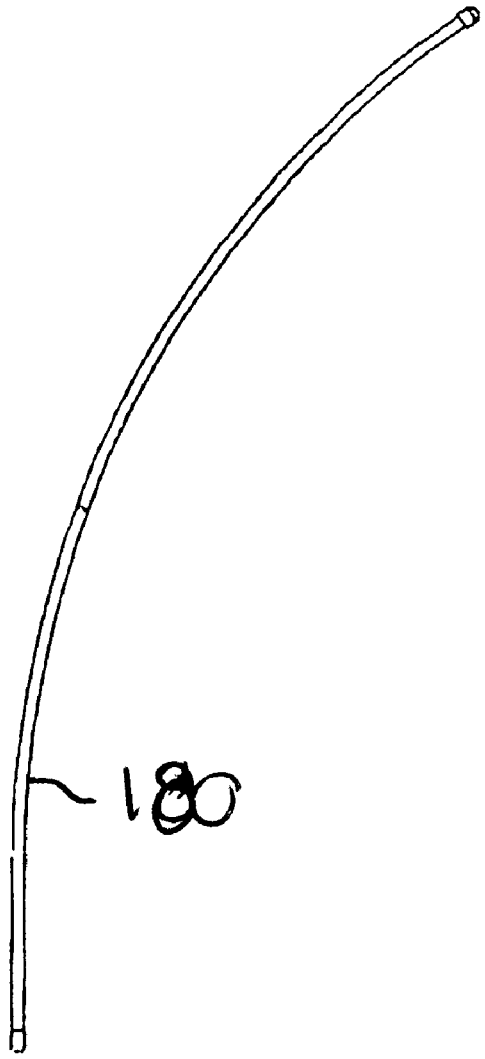
FIG. 14 illustrates the flexure of the tube in FIG. 13.

Referring to FIG. 13, there is shown the construction of a two segment tube (180) that would be used for the smaller sail configuration (140) shown in FIG. 10. In FIG. 13, tube segments (182) and (184) are joined at joint (186). The construction of the joint (186) is identical to the construction set out above for the three segment tube. However, segment (182) and (184) are of equal outer diameter and their tube wall thickness is the same. Therefore, as shown in FIG. 14 the amount of flexure of the frame member (180) will be less than that of the longer frame member (134) in FIG. 12 in similar wind conditions. The operation of the smaller sail and shorter tube (180) is substantially the same as for the larger sail and longer tube. At higher wind speeds or during wind gusts, the tube (180) will flex to spill wind out of the sail. This lowers the effective center of effort of the sail and permits a controlled application of force to the sail thereby minimizing destabilizing movements of the kayak. Again the sail is freestanding and requires no paddler operations once the sail is set.

Figure 15:
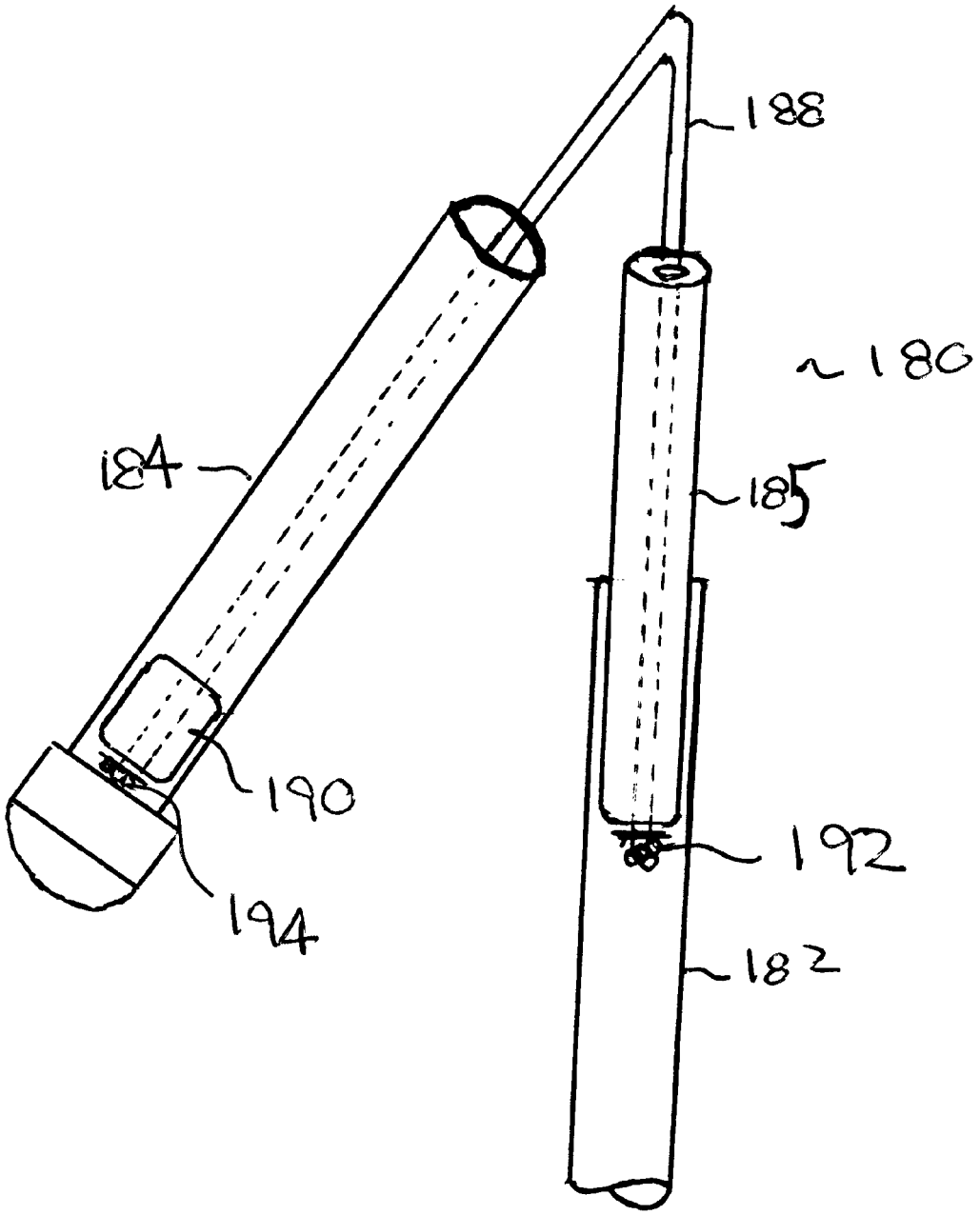
FIG. 15 illustrates the detail of a joint between two segments of a sail frame tube in one embodiment of my invention.

Referring to FIG. 15, there is shown a more detailed view of the tube (180). Segments (182) and (184) are shown disassembled. Dowel (185) is inserted into the top of segment (182) and fixed in place. The exposed end of the dowel (185) is adapted to receive by insertion the bottom portion of top segment (184). Tension cord is placed within the tubes and anchored at the top end of top segment (184) by an anchor means (190). The anchor means can be a section of dowel fixed into place. The tension cord is then anchored by a washer and knot assembly (192) and (194) at its ends. As with the longer tube for the larger sail, the tension cord compresses the two segments together at the joint and keeps the segments together for stowage and for sailing.

Figure 16:
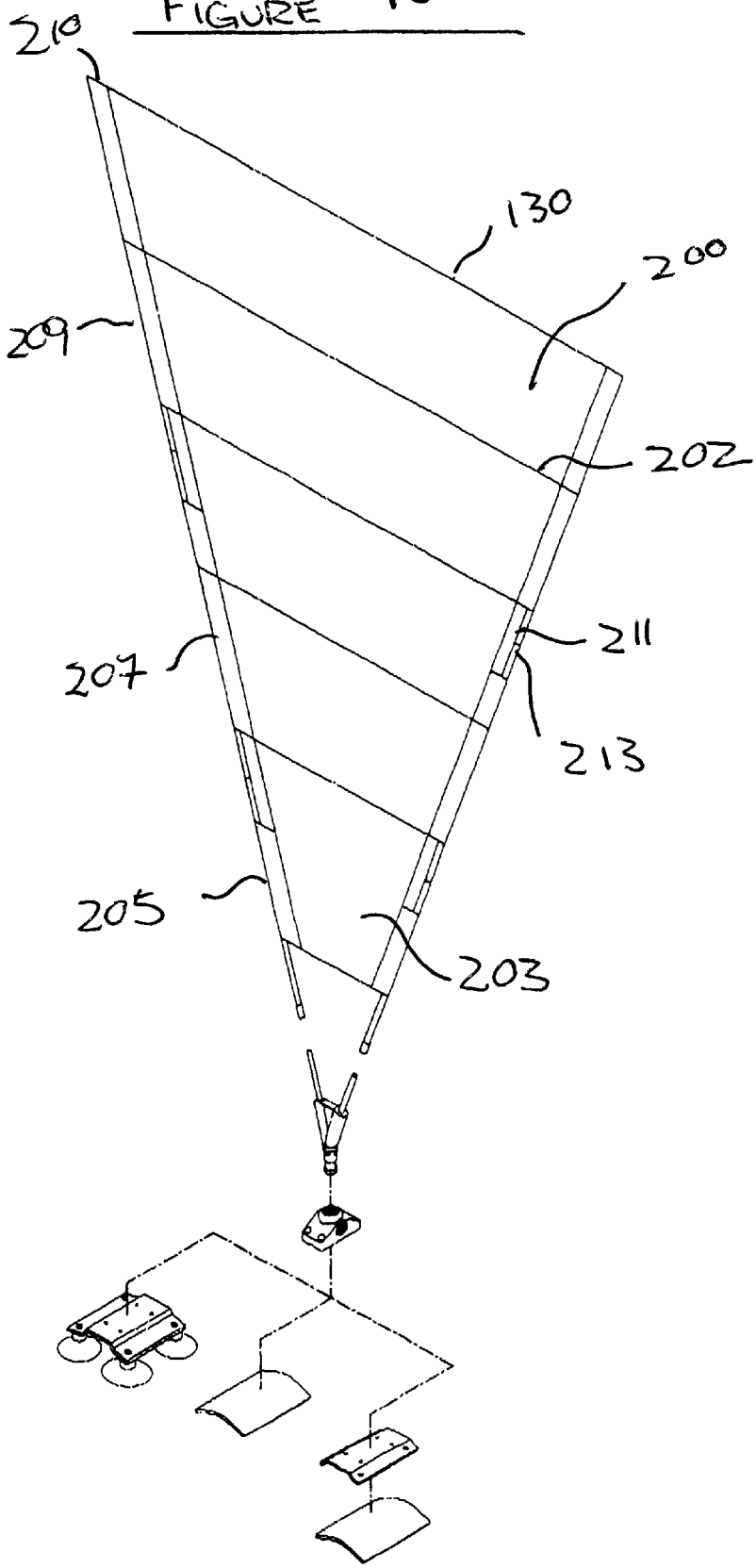
FIG. 16 illustrates the details the sail in another embodiment of my invention.

Referring now to FIG. 16, additional details of the sail are described. FIG. 16 describes a larger sail but the construction of the smaller sail is substantially the same. The sail (130) is comprised of a plurality of panels (200) fixed together at their joints (202). Generally the panels are sewn together but they may also be glued together. The panels are fabricated from a light weight, flexible yet strong polymeric material such as nylon or polyester. Included in the sail design is a window panel (203) located at the bottom thereof so that the operator may see through the sail. The window is made from a suitable transparent plastic flexible material. The tubes are inserted from the bottom of the sail through guide sleeves (205) and (207) into pocket (209) which is closed at the top end (210). Advantageously there are gaps (211) between the sleeves at the joints (213) to permit the tubes to be collapsed with the sail attached for easy assembly, disassembly and stowage.

Referring back to FIG. 2, there is shown another embodiment of my invention. There may be situations where the locking-base (10) cannot be mounted on a horizontal surface such as the deck of a kayak and must be mounted on a vertical surface. Horizontal bore (11) is located in the center of the front side (26) and penetrates the locking-base to the back side (28). The horizontal bore (11) intersects with the vertical bore (18) within the locking-base. The top portion (13) of the horizontal bore is ringed with a plurality of splines (15) spaced equidistantly about its inner circumference. These splines have the same function and operation as the splines (22) described above for the horizontal mounting and are adapted to receive the yoke stem (80) and intermesh with the splines (96) located there on. The locking mechanism described above also functions in this vertically mounted embodiment. The gap (94) in the collar (92) at the bottom of the yoke stem will engage the key (24) located in the center of the horizontal hole and permit insertion of the yoke only when the axis of the yoke is parallel to the axis of vertically mounted receiving block. The yoke may be easily positioned in 30 degree off-set increments and then fully inserted into the receiving block so as to fix the sail in a desired position.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A portable sailing kit for wind propulsion of vessels and vehicles said kit comprising:

a. a V-shaped sail for mounting to vessels and vehicles;

b. a flexible sail frame comprising two flexible elongated tubular framing members wherein each of said two flexible elongated tubular framing members is parallel to and attached along the length of a respective side of the V-shaped sail so that during operation, the V-shaped sail and said flexible sail frame act in combination to permit, by flexure of the two elongate tubular framing members by up to ninety degrees from the vertical, automatic adjustment of the effective area and centre of effort of the V-shaped sail upwards and downwards as a function of wind speed and without operator involvement;

c. a locking base mountable to vessels and vehicles in a vertical or horizontal orientation said locking base having a first bore from a top surface of the locking base to a bottom surface of the locking base and a second bore from a front surface of the locking base to a back surface of the locking base wherein said first and second bores intersect in the centre of the locking base and wherein there is disposed a key member at the intersection of said first and second bores so that said key member is located in the middle of each bore;

d. further wherein the top surface of the locking base includes a collar rising there from and surrounding the top end of the first bore and wherein said collar has a vertical inner surface comprising a plurality of splines disposed equidistantly and radially about said vertical inner surface and further wherein the length of said splines is substantially the height of the collar and further wherein said splines have rounded upper ends;

e. a molded "Y" shaped body adapted to hold the flexible sail frame in a vertical and freestanding orientation, said "Y" shaped body having:

i. a cylindrical stem portion adapted to be received by a said bore of said locking base;

ii. a furcated top portion comprising internally reinforced tubes inserted into each bifurcation and adapted to connect to and support a said flexible elongated tubular framing member;

iii. a middle portion adapted to transmit forces from the flexible sail frame to the locking base; and, iv. wherein said cylindrical stem portion includes a split ring located at its distal end, said split ring having two gaps therein disposed opposite to each other, said split ring having a flat upper surface and further wherein the top portion of said cylindrical stem includes a plurality of splines disposed radially around the top portion of the said cylindrical stem.

2. The kit as claimed in claim 1 wherein each of the flexible elongated tubular framing members comprise a bottom elongated tubular segment coupled together by coupling means with at least one top elongated tubular segment thereby forming at least one joint between them and wherein a bottom end of the bottom elongated tubular segment is adapted for insertion onto the "Y" shaped body.

3. The kit as claimed in claim 2 further including a tension cord located within each of the coupled tubular segments forming the flexible elongated tubular framing member said cord anchored to and connecting a top end of a top tubular segment with a top end of a bottom tubular segment thereby joining the tubular segments together so that when the tubular segments are coupled the tension cord provides a compressive force to the joints between the coupled tubular segments to maintain the relative positional relationship between the tubular segments and further when the tubular segments are pulled apart they will remain joined and proximate to each other for stowage.

4. The kit as claimed in claim 1 wherein the wall thickness of the elongated tubular framing members diminishes from the bottom of the framing members to the top of the framing members thereby imputing to the framing member an increasing capacity for flexure from bottom to top.

5. The kit as claimed in claim 1 wherein the cylindrical stem portion of the "Y" shaped body is locked into the locking base by a first and second locking means.

6. The kit as claimed in claim 1 wherein the front portion of the second bore has an inner surface comprising a plurality of splines disposed equidistantly and radially about said inner surface and wherein said splines are identical in shape and size to the splines disposed within the collar.

7. The kit as claimed in claim 5 wherein said first locking means comprises engagement between the top flat surface of the split ring and the bottom surface of the key said engagement caused by first inserting the cylindrical stem portion of the "Y" shaped body in either the first or second bore such that one of the two gaps disposed within the split ring slides by the key member located in either the first or second bores and then turning the cylindrical stem portion of the "Y" shaped body to a desired angle whereby any movement of the stem out of either the first or second bore will result in the upper surface of the split ring engaging the lower surface of the key member thereby locking the cylindrical stem portion of the "Y" shaped body vertically within the locking base.

8. The kit as claimed in claim 5 wherein the second locking means comprises intermeshing engagement of splines disposed around the top portion of the cylindrical stem portion of the "Y" shaped body with the splines disposed in the locking-base such that the "Y" shaped body is permitted rotation within either the first or second bore in thirty degree increments and such that once the stem is fully inserted in either the first or second bore the splines are fully and disengagably engaged and the rotational movement of the cylindrical stem portion of the "Y" shaped body within the locking base is prevented.

9. A portable sailing kit for wind propulsion of vessels and vehicles said kit comprising:

a. a V-shaped sail for mounting to vessels and vehicles;

b. a flexible sail frame comprising two flexible elongated tubular framing members wherein each of said two flexible elongated tubular framing members is parallel to and attached along the length of a respective side of the V-shaped sail and wherein the wall thickness of the two elongated tubular framing members diminishes from the bottom of the two elongated tubular framing members to the top of the two elongated tubular framing members thereby imputing to the two elongated tubular framing members an increasing capacity for flexure from bottom to top, so that during operation, the V-shaped sail and said flexible sail frame act in combination to permit, by flexure of the two elongate tubular framing members by up to ninety degrees from the vertical, automatic adjustment of the effective area and centre of effort of the V-shaped sail upwards and downwards as a function of wind speed;

c. a locking base mountable to vessels and vehicles in a vertical or horizontal orientation said locking base having a first bore from a top surface of the locking base to a bottom surface of the locking base and a second bore from a front surface of the locking base to a back surface of the locking base wherein said first and second bores intersect in the centre of the locking base and wherein there is disposed a key member at the intersection of said first and second bores so that said key member is located in the middle of each bore;

d. further wherein the top surface of the locking base includes a collar rising there from and surrounding the top end of the first bore and wherein said collar has a vertical inner surface comprising a plurality of splines disposed equidistantly and radially about said vertical inner surface and further wherein the length of said splines is substantially the height of the collar and further wherein said splines have rounded upper ends;

e. a molded "Y" shaped body adapted to hold the flexible sail frame in a vertical and freestanding orientation, said "Y" shaped body having;

i. a cylindrical stem portion adapted to be received by a said bore of said locking base wherein said cylindrical stem portion is locked into the locking base by a first and second locking means;

ii. a furcated top portion comprising internally reinforced tubes inserted into each bifurcation and adapted to connect to and support a said flexible elongated tubular framing member;

iii. a middle portion adapted to transmit forces from the flexible sail frame to the locking base; and, iv. wherein said cylindrical stem portion includes a split ring located at its distal end said split ring having gaps therein disposed opposite to each other, said split ring having a flat upper surface and further wherein the top portion of said cylindrical stem includes a plurality of splines disposed radially around the top portion of the said cylindrical stem.

10. The kit as claimed in claim 9 wherein each of the flexible elongated tubular framing members comprise a bottom elongated tubular segment coupled together by coupling means with at least one top elongated tubular segment thereby forming at least one joint between them and wherein a bottom end of the bottom elongated tubular segment is adapted for insertion onto the "Y" shaped body.

11. The kit as claimed in claim 10 further including a tension cord located within each of the coupled tubular segments forming the flexible elongated tubular framing member said cord anchored to and connecting a top end of a top tubular segment with a top end of a bottom tubular segment thereby joining the tubular segments together so that when the tubular segments are coupled the tension cord provides a compressive force to the joints between the coupled tubular segments to maintain the relative positional relationship between the tubular segments and further when the tubular segments are pulled apart they will remain joined and proximate to each other for stowage.

12. The kit as claimed in claim 9 wherein the front portion of the second bore has an inner surface comprising a plurality of splines disposed equidistantly and radially about said inner surface and wherein said splines are identical in shape and size to the splines disposed within the collar.

13. The kit as claimed in claim 12 wherein said first locking means comprises engagement between the top flat surface of the split ring and the bottom surface of the key said engagement caused by first inserting the cylindrical stem portion of the "Y" shaped body in either the first or second bore such that one of the two gaps disposed within the split ring slides by the key member located in either the first or second bores and then turning the cylindrical stem portion of the "Y" shaped body to a desired angle whereby any movement of the stem out of either the first or second bore will result in the upper surface of the split ring engaging the lower surface of the key member thereby locking the cylindrical stem portion of the "Y" shaped body vertically within the locking base.

14. The kit as claimed in claim 13 wherein the second locking means comprises intermeshing engagement of splines disposed around the top portion of the cylindrical stem portion of the "Y" shaped body with the splines disposed in the locking-base such that the "Y" shaped body is permitted rotation within either the first or second bore in thirty degree increments and such that once the stem is fully inserted in either the first or second bore the splines are fully and disengagably engaged and the rotational movement of the cylindrical stem portion of the "Y" shaped body within the locking base is prevented.

* * * * *